United States Patent [19]

Quaile

[11] Patent Number: 4,890,437

[45] Date of Patent: Jan. 2, 1990

[54] SEGMENTED ARCH STRUCTURE

[76] Inventor: Allan T. Quaile, 21 Vega Starway, Willowdale, Ontario, Canada, M2J 1N6

[21] Appl. No.: 71,427

[22] Filed: Jul. 9, 1987

[51] Int. Cl.[4] ..... E04C 3/12

[52] U.S. Cl. ..... 52/690; 52/86; 52/227

[58] Field of Search ..... 52/86, 89, 81, 638, 52/639, 640, 641, 82, 228, 229, 80, 227, 455, 456, 693, 695, 690

[56] References Cited

U.S. PATENT DOCUMENTS

| | | | |
|---|---|---|---|
| 2,376,906 | 5/1945 | Davidson . | |
| 2,874,812 | 2/1959 | Clevett, Jr. . | |
| 2,877,506 | 3/1959 | Almoslino . | |
| 2,936,862 | 5/1960 | Cvikl | 52/640 |
| 3,464,168 | 9/1969 | Russell et al. . | |
| 3,572,002 | 3/1971 | Nichols . | |
| 3,798,851 | 3/1974 | Utahara . | |
| 3,857,213 | 12/1974 | Miyake . | |
| 3,908,329 | 9/1975 | Walters . | |
| 4,071,985 | 2/1978 | Wickwire | 52/86 |
| 4,071,986 | 2/1978 | Wickwire | 52/81 |
| 4,161,089 | 7/1979 | Omansky | 52/227 |
| 4,284,094 | 8/1981 | Behrend . | |
| 4,344,262 | 8/1982 | Berman et al. . | |
| 4,373,305 | 2/1983 | Russell . | |
| 4,412,405 | 11/1983 | Tucker . | |
| 4,422,268 | 12/1983 | Mueller et al. . | |
| 4,590,721 | 5/1986 | Berg et al. . | |
| 4,593,710 | 6/1986 | Stafford et al. | 52/86 |
| 4,663,898 | 5/1987 | Yacaboni | 52/81 |

FOREIGN PATENT DOCUMENTS

| | | | |
|---|---|---|---|
| 233611 | 4/1971 | Fed. Rep. of Germany | 52/86 |
| 1052362 | 9/1953 | France | 52/86 |
| 767317 | 9/1980 | U.S.S.R. | 52/86 |
| 684218 | 12/1952 | United Kingdom | 52/86 |
| 871159 | 6/1961 | United Kingdom | 52/86 |

*Primary Examiner*—Michael Safavi

*Attorney, Agent, or Firm*—R. Craig Armstrong

[57] ABSTRACT

An arch structure is prefabricated from compression segments, the structure generally comprising one or more arch arcs with end anchor elements. Each arch segment comprises a trapezoidal frame structure fabricated from short lengths of sawn lumber, and fastened at the corner junctions of the respective individual members to form the respective arch segment element. The arch radius is determined by segment geometry. The arch segments are assembled in combination with one or more elongated pre-stressing elements and the pre-stressing elements tensioned to a sufficient extent, relative to the geometry and applied load to be born by the arch, that, in combination with other inter-element mechanical fastening means such as nails or bolts the arch elements are maintained substantially under compression across the abutting segment end faces. The arch is generally pin jointed at its ends, and frequently at the center thereof, to preclude the development of local bending moments at the base and apex of the arch. Internal segment braces form a diamond-brace construction, having a lateral brace thereacross. An alternative X-brace construction, usually combining therewith a lateral pair of struts to the center points of the parallel frame members of the trapezoidal frame, can be used. Shifting of the axis of compression may also be readily effected with use of K-form bracing and single side or double sided sheath bracing.

5 Claims, 3 Drawing Sheets

FIG.3.
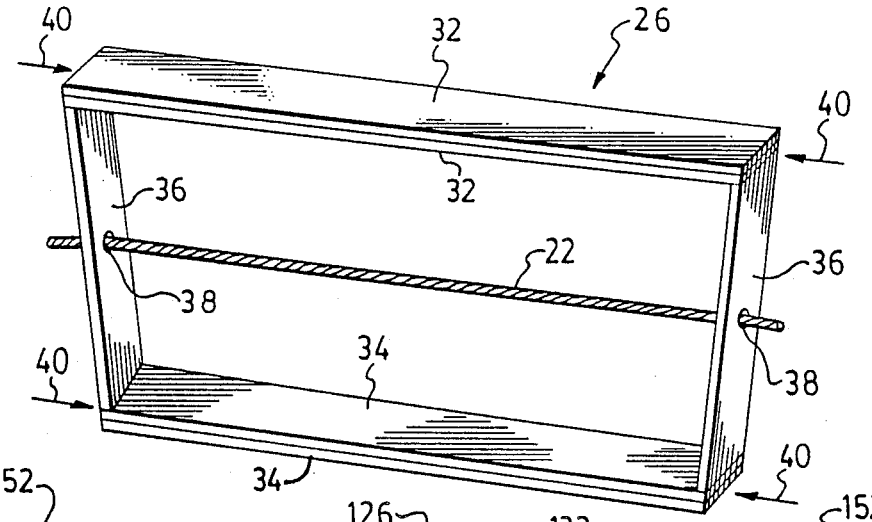
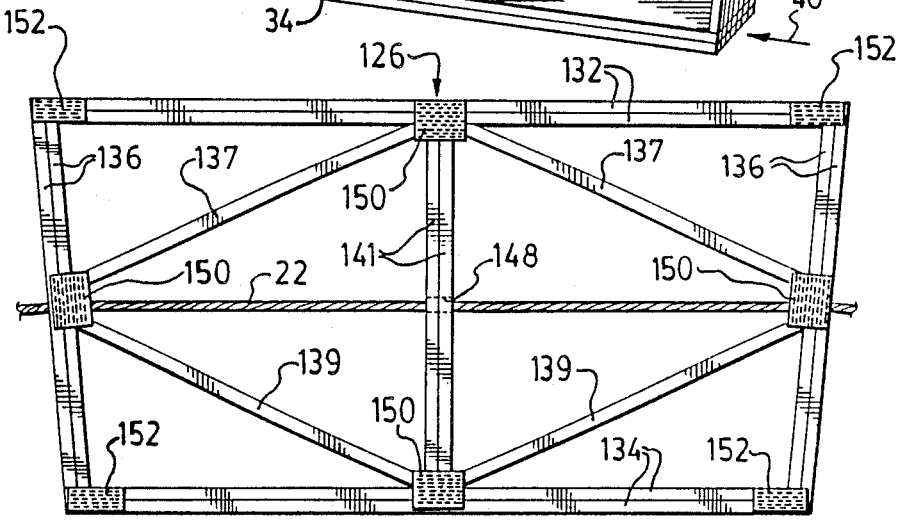
FIG.4.
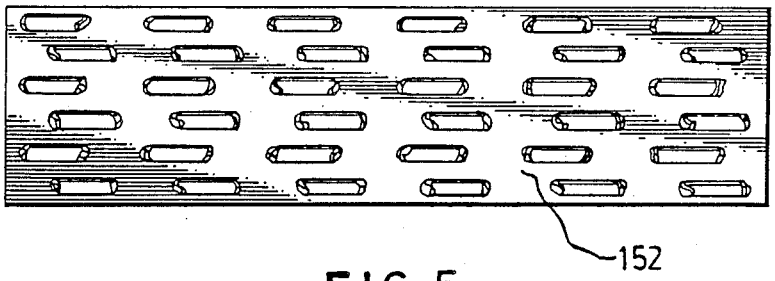
FIG.5.

SEGMENTED ARCH STRUCTURE

BACKGROUND OF THE INVENTION

This invention relates to a building component, and more particularly to a demountable structure of rigid construction in the form of an arch.

The use of wood as a construction material is well known, ranging from use in single joists in house construction to complex arches of glued, laminated (glulam) construction and other fabricated structures.

In U.S. Pat. No. 2,874,812 CLEVETT, Feb. 24, 1959, there is a form of archway utilizing pre-fabricated knock-down cardboard or sheet metal units mounted upon wedge-like stabilizer end plates, by means of which the unit walls are stabilized, and relative angular orientation between adjoining units is achieved. A tension rod and cable is threaded through the units, to secure them in firmly secured relation, as a curved beam or as a straight pole.

In U.S. Pat. No. 4,412,405 TUCKER, Nov. 1, 1983, there is illustrated a complex arch construction comprising lengths of board having the ends thereof jointed, the boards being arranged edgewise, in mutual interlocking relation, by way of the joints.

The CLEVETT arrangement is not adequate for construction industry trade and has not been generally adopted while the TUCKER arrangement is unduly complex, both in regards to fabrication of the components and the assembly of the components into units.

Also known, historically are bridge vault structures made out of heavy timbers dogged together, and providing a massive, heavy weight construction of relatively low material untilization factor.

SUMMARY OF THE PRESENT INVENTION

The present invention provides a light weight arch construction incorporating short lengths of wood of comparatively light section, pre-fabricated under conditions favouring rapid, high accuracy, low cost assembly, utilizing existing highly efficient truss plates for reliable, high strength arch segment assemblies, wherein the pretension loading applied to the assembly utilizes the ideal load bearing capability of the wood components, namely parallel to grain compressive loading, for optimised safe performance.

This invention provides a demountable segmented arch construction fabricated from standardized individual units made of sawn lumber, which may be assembled from precut components and erected with a minimum of skill and equipment.

This invention provides a method of applying longitudinal compressive forces to the arch segments such that tensile stresses in and between the segments may be substantially precluded thus limiting or negating the need for tension-type connections between the segments.

This invention provides a demountable arch which is modular in nature, such that it can be adapted to a number of widely differing uses, incorporating pre-stressing tension means to preload the individual components of each structure to a sufficient degree, in compression, to substantially preclude relative separation between adjoining surfaces of adjacent arch segments under loaded, operating conditions.

The present invention thus provides a prefabricated arch structure segment of substantially trapezoidal side profile, for assembly with similar segment units, positioned end to end in assembled relation with at least one elongated tensile pre-stressing unit, the segments each having a plurality of short, stiff, substantially straight wooden wall members, comprising; a first, radially outer chord member of a first, predetermined length; a second, radially inner chord member of a second, lesser length; at least two end members extending between the inner and the outer chord member in spacing relation between the ends thereof; fastening means securing the members in mutually fastened relation, and locating means for receiving the at least one pre-stressing tensile unit in located, load transfer relation relative to the wall members. In the preferred embodiment a series of triangulation braces within the segment stiffen the respective four walls at or adjacent their midpoints, including an additional transverse brace extending laterally mid ways of the longer sides.

It will be understood that the primary purpose of the bracing is to provide resistance to racking of the unit. X-form bracing and sheath bracing also may be used.

The relative transverse location of the pre-stressing tensile unit can be varied in accordance with the design and function of the structure.

There is further provided a method of erecting a light weight, structural timber archway comprising the steps of pre-fabricating a plurality of closed, braced, substantially trapezoidal arch segments each including passage means therethrough to receive a pre-stressing unit in guiding, laterally constraining relation therewith; mounting a predetermined number of the segments in end to end threaded relation on the pre-stressing unit, in mutual co-planar relation to form an arc of an archway; tensioning the pre-stressing unit to an extent, in combination with other inter-element jointing means such as bolts or nails to maintain the segments in mutual sandwiching relation to an extent in excess of anticipated segment separation forces acting on the segments as a consequence of segment self-weight and anticipated loads, and mounting the archway by the ends thereof.

In one construction a single arc of archway is employed, being mounted by the ends thereof between a pair of end anchor position, mounted on spaced apart footings. In another construction a pair of arcs are utilized, being jointed together, preferably by a pin joint, to preclude the transfer of bending moments therebetween, and mounting the two outer end anchor portions between a pair of spaced apart footings, also generally by way of a pair of pin joints.

BRIEF DESCRIPTION OF THE DRAWINGS:

Certain embodiments of the invention are shown, reference being made to the accompanying drawings, in which:

FIG. 3 is a perspective view of one embodiment of the trapezoidal segments;

FIG. 4 is an elevation view of a second, braced segment construction; and

FIG. 5 is a plan view of a truss plate used to join members.

Figure 1:
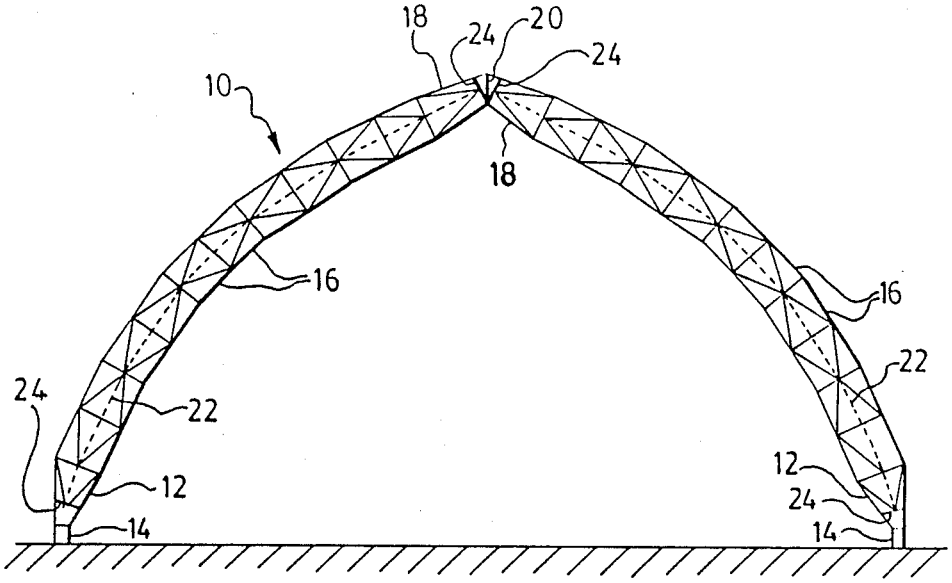
FIG. 1 is an elevation view of a three-hinged demountable segmented arch according to this invention.

DETAILED DESCRIPTION OF THE DRAWINGS:

Turning first to FIG. 1, a demountable arch 10 is shown, having two triangulated base segments 12 affixed to a pair of supporting walls or foundations, 14. The base segments 12 support a plurality of upwardly converging trapezoidal segments 16 and a pair of peak segments 18 which are joined together by a pin connection device 20. Two pre-stressing cable elements 22 (shown in phantom, for distinction) extend through the segments 12, 16 and the extremities of the cable elements 22 are attached to bearing seats 24 installed within the peak and base segments 18, 12.

Figure 2:
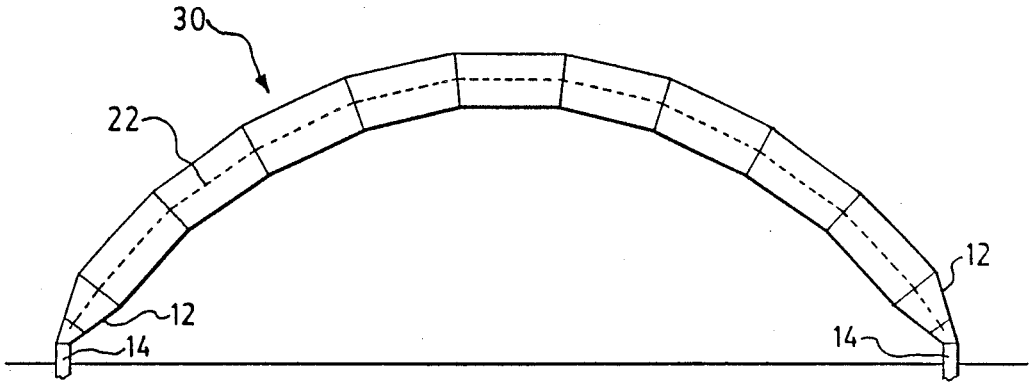
FIG. 2 is an elevation view of a two-hinged demountable segmented arch according to this invention.
Figure 6:
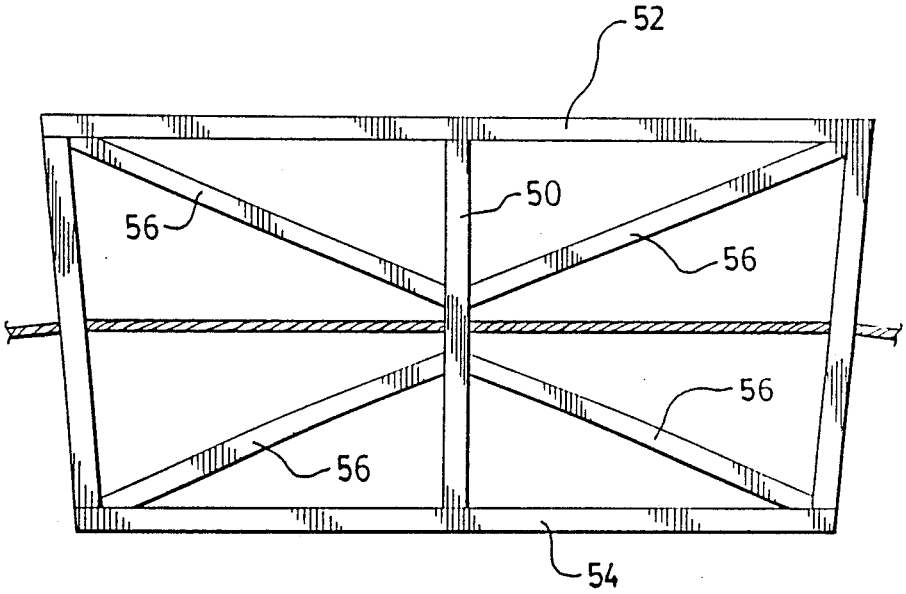

Turning to FIG. 2, a demountable arch 30 is shown and can be seen to consist of elements 16 similar to those of FIG. 1 except that the peak segments and their pin connections are omitted in favour of a continuation of the trapezoidal segments 16. Accordingly, the pre-stressing element extends in a continuous fashion from one base segment 12 through to the other base segment 12.

FIG. 3 shows the skeleton of an arch segment 26 in which six pieces of lumber 32,32; 34,34; 36,36 are jointed together to form a trapezoidal shape. The pre-stressing element 22 is shown passing through recess walls 38 in the centre of the end members 36. The principal forces which are imposed upon the segment 26 by the pre-stressing element 22 are represented by four arrows 40 acting to compress the doubled longitudinal members 32,34. Because the pre-stressing element 22 is inclined downward (inwardly) at each end of the segment 26, small inward components will be imposed on the segment 26 in this (inward) direction relative to the arch centre. Although it is not shown in this figure, in many installations the segments 26 require additional restraint or bracing which will limit or prevent distortion of the trapezoidal shape and flatwise buckling of the members 32, 34, 36, particularly longitudinal members 32. This bracing may take the form of a rigid panel (such as plywood or waferboard, not shown) fastened to one or both faces of the segment 26; alternately, the restraint mechanism may take the form of additional lumber installed between the members shown in FIG. 3 in the form of triangulation "X" or "K" bracing. Although the segment 26 in FIG. 3 shows doubled longitudinal member 32,32 and 34,34 and single transverse member 36, the invention is not limited to this configuration; the number, location, and dimensions of lumber members will depend upon the arch geometry and the load that the arch is required to withstand. Similarly, the length, depth, and angular geometry of the trapezoidal segments 26 will vary, depending upon loading, arch spacing, and span requirements.

Referring to FIG. 4, the frame 126 has double side member 132,132 and 134,134; and double end members 136,136 at each end.

Triangulated cross bracing 137,137; 139,139 connects the effective mid-points of respective sides 132,134, with the mid-points of the adjacent ends 136. A double transverse brace 141 spans the frame 126, having an aperture 148 therethrough for the pre-stressing element 22. Fastening of the respective members is effected by truss plates 150,152.

The fastening of the pieces of lumber together within a segment may be accomplished with mechanical fasteners such as nails or truss plates 152 shown in FIG. 5 or with adhesives. The joining of one segment to another adjacent segment may be accomplished with mechanical fasteners such as nails or bolts.

The base and peak segments 12,18 are those to which the pre-stressing elements are anchored. These segments 12,18 require internal transverse support members 19,21 to provide seats for the anchors and for the jacks that would normally be used to draw the pre-stressing elements up to the required tension.

The imposition of compressive forces along the length of the arch 10,30 by the pre-tensioning member 22 creates a tendency of the whole arch to buckle in the lateral direction. Stability in this lateral direction is provided by external arch-to-arch bracing. The bracing might take the form of external diagonal members, the provision of a diaphragm material in secured overlying relation at the roof level, or some combination of these.

The advantages of this invention can be seen in comparing it with a glued-laminated timber (glulam) arch. The glulam arch is a solid section built up to the required length, depth and curvature using laminating grades of lumber and glue. For most buildings the arch members are shipped and erected as full length sections. This means that they require special shipping, handling and erection procedures and equipment. For the invention described herein, the arch segments are small enough to be shipped and handled with light equipment. In the process of erection, the segments may be built up from the base connection by sequentially adding and fastening segments until the arch is complete. Requirements for temporary support can be minimized by providing fastener connections such as nails or screws between the segments, that are strong enough that the fastened arch segments will support the arch self weight. After the arch has been completely assembled and provided with external lateral stabilization, the internal pre-stressing elements 22 may be added, thus developing in the arch its full measure of resistance to bending and shear forces.

The magnitude of the pre-stressing force is selected on the basis of the arch geometry and the design loads to be withstood.

It will be understood that while a single pre-stressing element 22 has been illustrated, two or more, of steel, glass fibre, nylon etc., may be used, and tensioned to a desired extent.

Continuing the comparison of this invention with conventional timber arches, it is noteworthy that segmentation of timber arches is generally considered to be problematic. This is because of the difficulty and expense of providing connections to join the segments. In particular, bending moments impose compression forces along one edge of the arch and tension forces on the other; it is the tension force that is most difficult to resist in wood connections and these connections can make the arch uneconomical for use. In the present invention, the pre-stressing element imposes a clamping force along the length of the arch and this clamping force can be made sufficiently large that tensile stresses in the segment connections are reduced or eliminated. This greatly simplifies the design and erection of the arch segments.

The segmented arch of this invention lends itself well to a variety of uses. Arches arranged side by side along parallel foundations can be used to form, for example, barrel type storage buildings, implement sheds, aircrafts hangars, barns, garages, or factories. Similarly, these arches may be set on tied walls to form, for example, roofs for commerical, industrial, recreational or residential buildings. Alternately, the arches may be arranged with their bases on circular or polygonal foundation and their peaks meeting at a central hub, thus forming a domed roof; this shape lends itself well to storage of bulk materials.

The demountability of the subject arch means that buildings so constructed may be easily disassembled and removed; the subject arch is therefore well suited to construction of temporary buildings. The light weight of the arch-segments is also well suited to erection of buildings in remote locations where construction materials must be flown to the site. Another advantage of this subject arch is the fact that it uses standard, modular segments; thus the components can be used to construct arches in a variety of spans and lengths.

I claim:

1. An arch structure segment of substantially trapezoidal side profile, for assembly with similar segments, positioned end to end, in assembled relation with at least one elongated tensile pre-stressing unit, said segment having a plurality of short, stiff, substantially straight wooden wall members, comprising:

a first, radially outer chord member of a first predetermined length;

a second, radially inner chord member of a second, lesser length;

at least two end members extending between said inner and said outer chord members in spacing relation between the ends thereof;

mechanical fastening means securing said members in mutually fastened relation; and locating means for receiving said at least one pre-stressing tensile unit in located, load transfer relation relative to said wall members;

said segment including racking-resistant bracing means including struts joining substantially the mid-points of adjacent sides of said segment, and truss plate means in securing relation therewith.

2. The arch structure segment as set forth in claim 1, said bracing means further including a transverse strut joining substantially the mid-points of said radially outer and said radially inner chord members.

3. The arch structure segment as set forth in claim 2, having four corner joints and four intermediate bracing joints positioned intermediately of said corner joints, and truss plate means overlying said intermediate bracing joints in securing relation with the members thereof.

4. The arch structure segment as set forth in claim 1, having said chord members in substantially mutual parallel relation, said locating means comprising an aperture through each said end member, the walls of said apertures receiving said pre-stressing unit in predetermined locating and restraining relation therewith.

5. The arch structure segment as set forth in claim 2, having said chord members in substantially mutual parallel relation, said locating means comprising an aperture through each said end member, the walls of said apertures receiving said pre-stressing unit in predetermined locating and restraining relation therewith, said transverse strut including an aperture therethrough for said pre-stressing unit.

* * * * *